US006478240B1

(12) United States Patent
Dorkin et al.

(10) Patent No.: US 6,478,240 B1
(45) Date of Patent: Nov. 12, 2002

(54) DEVICE FOR GENERATING A GAS-DROPLET STREAM AND VALVE

(75) Inventors: Eduard Alexandrovich Dorkin, Moskow (RU); Alexandr Vladimirovich Karpyshev, Moscow (RU); Igor Alexandrovich Lepeshinsky, Moscow (RU)

(73) Assignee: Nauchno-Issledovatelsky Institut Nizkikh Temperatur pri MAI, Moscow (RU)

( * ) Notice: Subject to any disclaimer, the term of this patent is extended or adjusted under 35 U.S.C. 154(b) by 0 days.

(21) Appl. No.: 09/673,205

(22) PCT Filed: Apr. 9, 1999

(86) PCT No.: PCT/RU99/00112

§ 371 (c)(1),
(2), (4) Date: Oct. 13, 2000

(87) PCT Pub. No.: WO99/52643

PCT Pub. Date: Oct. 21, 1999

(30) Foreign Application Priority Data

Apr. 13, 1998 (RU) ..... 98106891

(51) Int. Cl.[7] ..... B05B 7/04
(52) U.S. Cl. ..... 239/433; 239/526; 239/600
(58) Field of Search ..... 239/600, 525, 239/526, 152, 303, 308, 311, 433, 434, 434.5, 398; 169/9, 14, 15, 30, 71, 74, 53, 85, 46, 52; 222/195, 399, 175

(56) References Cited

U.S. PATENT DOCUMENTS 3,759,450 A 9/1973 Fram et al.
3,915,388 A 10/1975 Nathan
4,827,972 A 5/1989 Graham
6,223,827 B1 * 5/2001 Zuev et al. ..... 169/14
6,311,780 B1 * 11/2001 Zuev et al. ..... 169/46

FOREIGN PATENT DOCUMENTS

| | | |
|---|---|---|
| EP | 0 088 881 | 9/1983 |
| GB | 1 325 113 | 8/1973 |
| RU | 94003528 | 10/1995 |
| RU | 2067711 | 10/1996 |
| RU | 2067712 | 10/1996 |
| RU | WO 98/01231 | 1/1998 |
| SU | 327355 | 4/1972 |
| SU | 1166835 | 7/1985 |

* cited by examiner

*Primary Examiner*—Lisa A. Douglas
(74) *Attorney, Agent, or Firm*—Rothwell, Figg, Ernst & Manbeck, PC

(57) ABSTRACT

The present invention relates to a device for generating a gas-droplet stream, wherein the said device includes a gas-dynamic nozzle (1), which is connected to a chamber (2) for mixing gas and liquid and containing a liquid flow dispersion system (3). The chamber (2) is connected to a liquid and gas supply system through a controlled valve, wherein the said valve ensures an early inlet of a gas flow prior to that of the liquid when the device is turned on, and cuts off the liquid supply when the said device is turned off. The valve comprises two closure members (5,6) which interact with the seats provided on the walls of sealed chambers (8,9) and which communicate respectively with liquid and gas supply ducts (10,11). The member (5) is rigidly connected to a rod (7) so as to be brought in contact with the seat in the gas supply chamber (8), while the member (6) is coaxially mounted on the said rod (7) so as to be capable of displacement along the same upon interaction with a stop.

25 Claims, 2 Drawing Sheets

DEVICE FOR GENERATING A GAS-DROPLET STREAM AND VALVE

FIELD OF ART

The present inventions relate to engineering devices designed for generating gas-droplet streams, which can be essentially used in fire fighting facilities to produce fog-type screens and directed fire extinguishing two-phase flows. Thereto, the inventions can be employed in farming—for field sprinkle and different substance dispersion, as well as at home, e.g., for disinfecting substance dispersion in the rooms.

PRIOR STATE OF THE ART

Known in the art are different types of devices for gas-droplet stream generation. Thus, e.g., the prior art device for liquid dispersion is known described in Application RU 94003528 A1, which includes a gas-dynamic nozzle connected with a toroidal vortex chamber, a water supply system connected with the chamber via injection channels, and an air supply system connected with the nozzle inlet.

During the operation of the said device the liquid is supplied through the injection channels into a toroidal vortex chamber in the form of thin streams. While outflowing through the nozzle, on account of pressure difference occurred in the vortex chamber, the liquid streams are caught by a gas flow and begin to crush into fine drops. With gas flow and liquid drop acceleration the further drop crushing takes place in the divergent part of the nozzle and an accelerated gas-droplet stream is produced at the nozzle exit. The number of injection orifices and their diameter allow to change the number and diameter of liquid streams in the vortex chamber, which finally effects the droplet diameter in a gas-droplet stream.

However, the said device does not allow independently to control liquid and gas supply to the mixing chamber during the operation. Besides, in the said device a gas-and-liquid flow acceleration is possible only in the divergent part of the nozzle, which excludes a possibility of using a nozzle in the form of a converging tube.

The mostly closely analogous device of the one claimed is the prior art device for generating a gas-droplet stream described in Application WO 98/01231 A1, which contains a gas-dynamic nozzle connected with a liquid and gas mixing chamber, a means of liquid flow dispersion supplied to a mixing chamber with injection orifices, and a liquid and gas supply system.

The mixing chamber location in front of the nozzle inlet allows to use changeable gas-dynamic nozzles of different configuration and size. To produce an accelerated air flow supplied to the mixing chamber the said device employs a turbocompressor unit as a part of a gas supply system. The structural embodiment, though allowing to control a gas flow and pressure, does not provide individual control of gas and liquid supply to the mixing chamber, which is necessary for the device operation with minimum working fluid losses and required fast operation in an impulse mode.

Known in the art are also the valves for two-phase working fluid supply, with the help of which one can control different component supply sequence forming a two-phase flow of a working fluid in the mixing chamber (see description of Patents RU 2067712).

The prior art valves include the supply chamber of different components divided by a movable partition sealed along the valve body by a sealing ring or a membrane, a closure member, a seat, and a control valve. The dividing partition has a ring band between a seat and a closure member. With a control signal entering the drive a control valve opens one channel and closes the other channel. As a result of this there occur a connection of a closure member control chamber with the mixing chamber and a closure member displacement on account of pressure drop in the chamber. Following the closure member opening there takes place a dividing partition displacement opening an annular channel, through which the second component enters the mixing chamber. With a control valve closure there, first of all, takes place a shut-down of the first component passage channel by the closure member and then comes a shut-down of the second component passage channel by a diving partition.

Therefore, in the said valve-mixer only a certain sequence of supply and supply cutoff of different components to the mixing chamber may be carried out, which does not meet a gas and liquid mixing chamber supply sequence required for generating a gas-droplet stream. Besides, a particular arrangement of valve units and its size do not allow to use any other means for liquid flow dispersion supplied to the mixing chamber.

The most closest analogous device of the valve claimed is the prior art three-way valve for a two-phase working fluid known from the Author's Certificate SU 327355 A, which has two closure members located on the rod and interacting with the seats, a rod displacement limiter, and a rod displacement control system. The valve seats are on the walls of the sealed chambers connected, accordingly, with liquid and gas supply pipes.

When the pressure drops in the gas chamber of the said valve there occurs a displacement up to a stop of a spring-controlled seat together with a closure member mounted on the rod. The second closure member also mounted on the rod, while displacing together with it, opens a liquid supply channel to the subvalve space. When the pressure rises, the displacement opposite to what has been described above and the gas supply channel opening to the subvalve space tale place.

This technical solution is aimed at excluding the working fluid mixing at the valve exit. On account of this the selection of liquid or gaseous phase from the vessel is carried out depending on its pressure.

Regardless of structural similarity a technical problem solved by the said valve is opposite to that one, at the solution of which the present invention is aimed, namely, control of gas and liquid flow mixing supplied to the mixing chamber in the form of a specific size droplet.

SUMMARY OF THE INVENTION

A group of present inventions patented are based on the problem of increasing the speed of attaining a required gas-droplet stream generation mode under continuous and impulse starts, as well as reducing the working fluid non-productive losses under the device multistarts. The solution of this problem, in its turn, is based on ensuring a possibility to control a liquid and gas supply to generate a two-phase flow in the mixing chamber, which is then accelerated in the nozzle with a gas-droplet stream formed.

The solution of these problems is aimed, on the whole, at increasing gas-droplet stream generation efficiency and its performance stability.

This technical result is achieved by the fact that in the device for generating a gas-droplet stream comprising a gas-dynamic nozzle connected with a liquid and gas mixing chamber, a means of liquid flow dispersion supplied to the mixing chamber with injection orifices, and a liquid and gas supply system, according to this invention the mixing chamber is connected with a liquid and gas supply system via a two-phase working fluid supply control valve made with a possibility of a preliminary gas flow supply to the mixing chamber, prior to liquid supply into it, when the device starts, and with a possibility of a preliminary cutoff of the liquid flow supplied to the mixing chamber prior to a cutoff of the gas flow fed into it, when the device is turned off.

In the preferred embodiment the nozzle is mounted on the mixing chamber body by a detachable connection. This allows to use changeable nozzles for different operating modes of the device.

It is preferred from the arrangement conditions that a controlled valve be fixed in a common body together with a mixing chamber.

For a comfortable position of the nozzle unit in one's hand the body is provided with at least one handle. In this case the handle must comprise a trigger mechanism for valve control.

The preferable embodiment of a controlled valve in the form of two closure members on the rod and interacting with the seats located on the sealed chamber walls connected, accordingly, with liquid and gas supply pipes. The valve also includes a rod displacement limiter, a stop rigidly fixed on the rod and a rod displacement control system. One closure member is rigidly fixed on the rod with a possibility of a seat contact in the gas supply chamber, the second stop valve is fixed coaxially on the rod with a possibility of displacement along it and interaction with the stop and the ability of a seat contact in the liquid supply chamber. Between the liquid supply chamber wall and a movable closure member is an elastic component pressing a movable closure member against a corresponding seat. In a normal closed position of the valve a supporting surface of the stop is located with a gap in relation to the opposite supporting surface of the movable closure member.

At least one spring mounted coaxially on the rod can be used as an elastic component.

The gap value is preferably chosen within the range of 0.3 to 1 mm.

The rod displacement control system may include at least one control valve.

It is preferable for the rod displacement control system to be made in the form of a pneumatic system.

Resulting from a device operation control convenience as a control element of a pneumatic system a trigger mechanism is employed placed in the body handle.

The mechanism trigger is hinged to a slide element of the control valve, with the slide element fixed in the valve body with the ability of a limited translation, an elastic component set up between a supporting surface of the slide element and a supporting surface of the device body, e.g., in the form of at least one spring.

A pneumatic system may be provided with a pneumatic cylinder, the piston of which is kinematically connected via a lever mechanism with a controlled valve rod. In this case an elastic component, e.g., in the form of at least one spring resting on the pneumatic cylinder body is fixed in the space above the piston.

The control valve is preferably manufactured with three connections. The first connection takes place with a controlled valve gas chamber. The second connection takes place with a pneumatic cylinder control chamber. The third connection takes place with draining. The slide element has channels linking via the corresponding connection, under the initial position of the trigger mechanism, a pneumatic cylinder control chamber with draining, and while pressing the trigger—a controlled valve gas chamber with a pneumatic cylinder control chamber.

It is also preferred that a liquid and gas supply system contain at least one pressurized gas bottle and one water tank, flexible hoses connecting a cylinder with a liquid chamber of the controlled valve and a cylinder with a gas chamber of the controlled valve and with a gas bottle pressurization cavity, and a gas pressure control valve. The supply system can also include stop valves fixed on liquid and gas supply pipes.

Depending on the size the tank and the bottle can be placed in the back-pack or on a transport means, e.g., a trolley, an automobile or an electromobile.

In utilizing the device as a means of fire extinguishing any liquid applied for this purpose, e.g., water can serve as a working fluid. With the other purpose and a corresponding embodiment of the device the working fluid may be the liquid applied for disaffection, (and/or) deodorization, (and/or) anticeptization of the rooms.

The said technical result is also achieved by the fact that the valve for two-phase working fluid supply comprising two closure members placed on the rod and interacting with the seats located on the sealed chamber walls connected respectively with liquid and gas supply pipes, as well as a rod displacement limiter, and a rod displacement control system according to the invention has a stop rigidly fixed on the rod, one closure member rigidly fixed on the rod with a possibility of a seat contact in a gas supply chamber, the other closure member coaxially mounted on the rod to be able to make a displacement along it, while interacting with a stop and with a possibility of a seat contact in a liquid supply system. Between a liquid supply chamber and a movable closure member is an elastic component in the form of at least, e.g., one spring pressing movable closure member to a respective seat. In a normally closed position of the valve the supporting surface of the stop is located with a gap in relation to the opposite supporting surface of a movable closure component.

The gap value is preferably selected within the range of 0.3 up to 1 mm.

The rod displacement control system structure may include at least one control valve.

It is preferable to carry out a rod displacement control system in the form of a pneumatic system.

A pneumatic system is preferably provided with a pneumatic cylinder, the piston of which is kinematically connected via a lever mechanism with the rod. In this case an elastic component in the form of, e.g., at least one spring resting on the pneumatic cylinder body is mounted in the space above the piston.

A controlled valve is preferred to be manufactured with three connections. The first connection of the valve is with a gas chamber. The second connection communicates with a control pneumatic cylinder chamber. The third connection communicates with draining. The slide component has channels linking via the corresponding connection, under the initial position of a trigger mechanism, the pneumatic cylinder control chamber with draining, and while pressing the trigger—a gas chamber with a pneumatic cylinder control chamber.

BRIEF DESCRIPTION OF THE DRAWINGS

Hereinafter a group of inventions patented will be described with reference to a specific embodiment illustrated in the accompanying drawings, wherein.

PREFERRED EMBODIMENTS OF THE INVENTION

Figure 1:
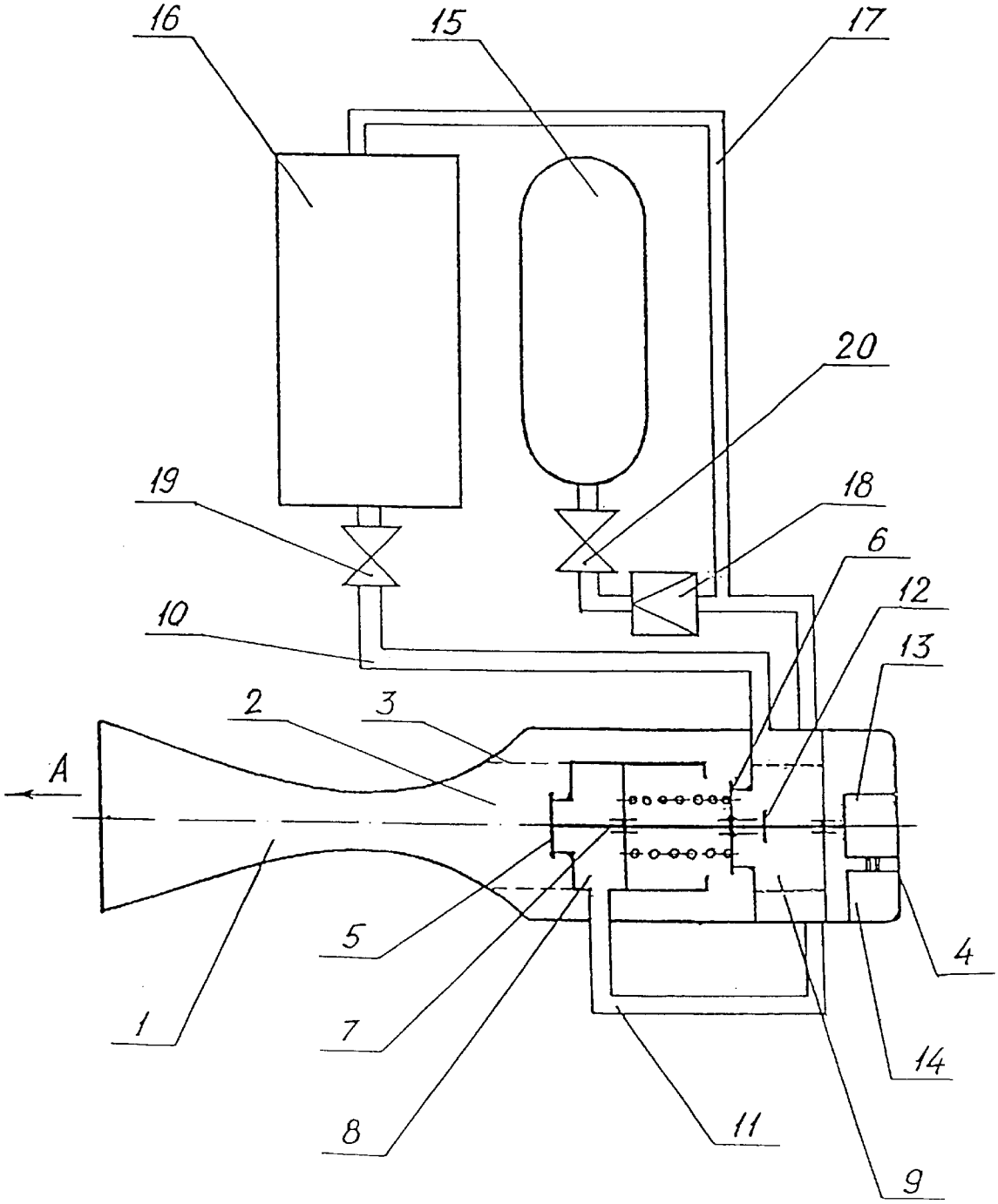
FIG. 1 is a general principal view of a device according to the invention patented.

A device patented for generating a gas-droplet stream, the diagram of which is illustrated in FIG. 1, comprises a gas-dynamic nozzle 1 connected with a liquid and gas mixing chamber 2, a liquid dispersion means 3 supplied to a mixing chamber 2. The means 3 is manufactured in the form of a cylindrical rigid wall with injection orifices. The mixing chamber is connected with a liquid and gas supply system via a two-phase working fluid supply control valve made with a possibility of preliminary gas flow supply to the mixing chamber prior to the liquid flow supply at the start of the device, and with a possibility of a preliminary liquid supply cutoff to the mixing chamber prior to the cutoff of a gas flow supplied into it.

The nozzle is mounted on the mixing chamber body by means of a detachable connection (not shown in the drawing). A controlled valve is fixed in a common body 4 together with the mixing chamber 2.

The controlled valve is made in the form of two closure members 5 and 6 fixed on the rod 7. The closure members 5 and 6 interact with the seats located on the sealed chamber walls 8 and 9 connected respectively with liquid and gas supply pipes 10 and 11 made in the form of flexible hoses. The valve comprises also a stop 12 rigidly fixed on the rod 7 and a rod displacement control system, the structure of which includes a drive 13 with a rod displacement limiter and a control unit.

The closure member 5 is rigidly fixed on the rod 7 with a possibility of a seat contact. The other closure member 6 is fixed coaxially on the rod 7 with a displacement possibility along it, while interacting with a stop 12 and a possibility of a seat contact in the liquid supply chamber 9. Between the liquid supply chamber 9 wall and a movable closure member 6 there is a spring fixed coaxially to the rod 7 pressing the movable closure member 6 against a respective seat. In a normally closed position of the valve the supporting surface of the stop 12 is located with a gap in relation to the opposite supporting surface of the movable closure member 6. The gap value is 0.3 to 1 mn.

The liquid and supply system contains at least one pressurized gas bottle 15 and one water tank 16. The working gas is air, the working fluid is any liquid used for fire extinguishing—in the case considered, it is water. One flexible hose 10 connects the tank 16 with a liquid supply chamber 9 of the controlled valve, the other flexible hose 11 connects the bottle 15 with the gas supply chamber 8 of the controlled valve. Another flexible hose 17 connects the bottle 15 with a tank 16 pressurization gas system 8. The supply structure also includes a gas pressure regulator 18 and valves 19 and 20 fixed accordingly on liquid and gas supply pipes.

The tank 16 and the bottle 15 with the other supply system components with their relatively small size are arranged in the back-pack. With a considerable tank capacity (more than 10 l) they are arranged together with the other supply system components on a transport means in the form of a wheeled trolley (not shown in the drawing).

Figure 2:
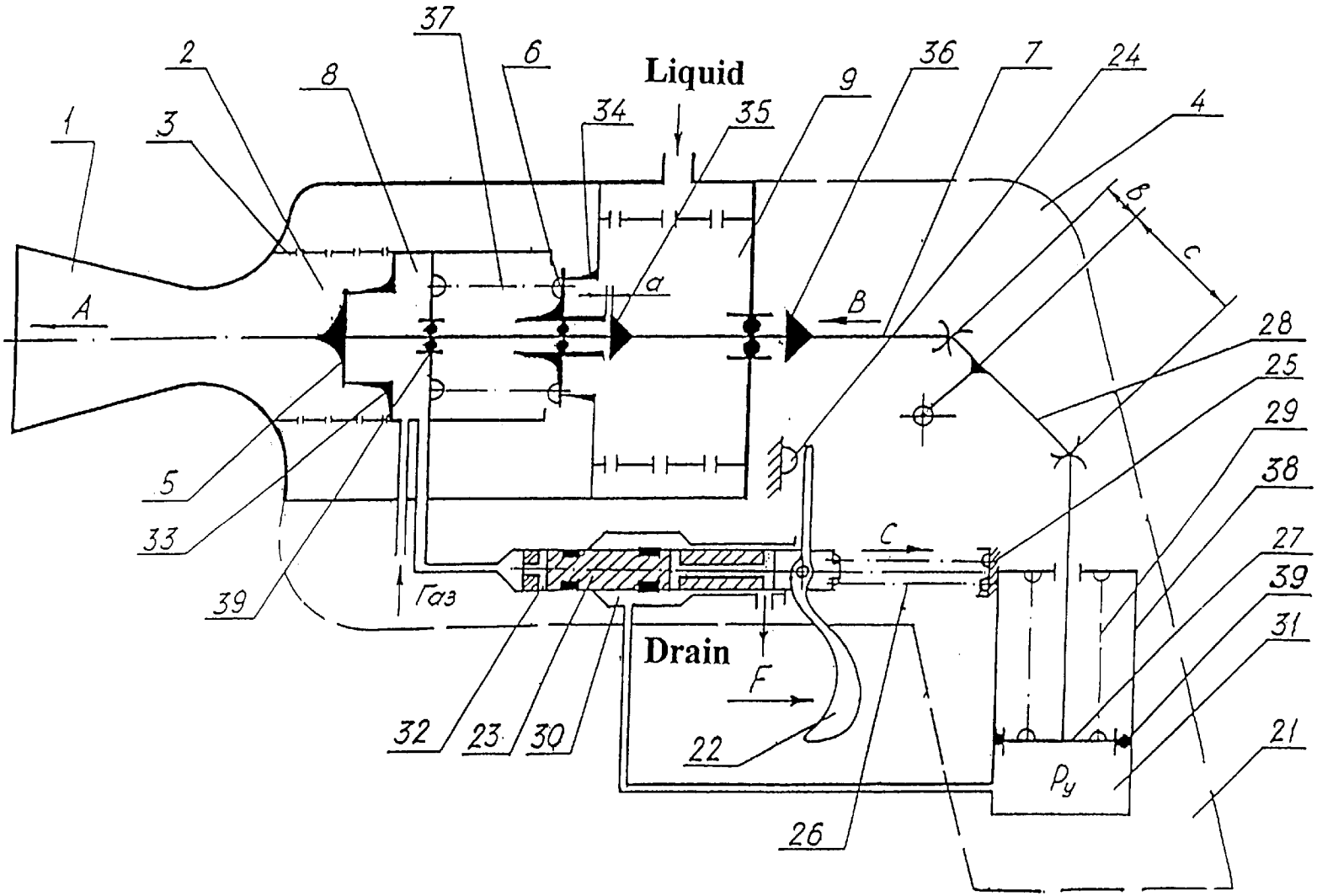
FIG. 2 diagrammatically illustrates a nozzle, a mixing chamber and a two-phase working fluid supply valve mounted in a common body according to one of the invention embodiments.

In the, preferred embodiment of the device illustrated in FIG. 2 the body 4, in which the gas and liquid mixing chamber and a controlled valve are placed, is provided with at least one handle 21. The rod displacement control system comprises a control valve, the control trigger mechanism of which is arranged in the handle 21.

The rod displacement control system is made in this case in the form of a pneumatic system, the control unit of which is a trigger 22 mounted in the handle 21. The mechanism trigger 22 is hinged to the slide component 23 of the control valve and has a support 24. The slide component 23 is fixed in the valve body with a possibility of a limited translation. Between the supporting surface of the slide component 23 and the supporting surface of the device body 25 is a spring 26.

The control pneumatic system is provided with pneumatic cylinder, the piston of which is kinematically connected via a lever mechanism 28 with the control valve rod 7. A spring 29 resting on the pneumatic cylinder body is fixed in the space above the piston 27.

The device control valve is made with three connections. The first connection of the valve (see FIG. 2) is with the gas chamber 8 of the controlled valve. The second connection linked with the control chamber 30 communicates with the control chamber 31 of the pneumatic cylinder. The third connection is with draining (see Drain in FIG. 2).

The slide component 23 has channels 32 linking via the respective connection, under the initial position of the trigger mechanism, the pneumatic cylinder control chamber 31 with draining, and while pressing the trigger 22—the control valve gas chamber 8 with the pneumatic cylinder control chamber 31.

The valve for a two-phase working fluid supply used in the device for generating a gas-droplet stream as a controlled valve has two closure members 5 and 6 fixed on the rod 7 and interacting with the seats 33 and 34 located on the sealed chamber walls 8 and 9. Liquid 9 and gas 8 chambers are connected accordingly with liquid and gas supply pipes (see Liquid and Gas in FIG. 2).The valve shown in FIG. 2 has also a rigidly fixed stop on the rod 7, the rod 7 displacement limiter and the rod 7 displacement control system.

One closure member 5 is rigidly fixed on the rod 7 with a possibility of a seat 33 contact in the gas supply chamber 8. The second closure member 6 is coaxially fixed on the rod 7 with a possibility of displacement along it, while interacting with the stop 35 and a possibility of a seat 34 contact in the liquid supply chamber 9. Between the liquid supply chamber 9 wall and a movable closure member 6 a spring 37 pressing the movable closure member 6 to the seat 34 is mounted coaxially on the rod 7. In a normally closed position of the valve the supporting surface of the stop 35 is located with a gap "a" in relation to the opposite supporting surface of the movable closure member 6. The "a" gap value is 0.3 to 1 mm.

The rod 7 displacement control system made in the form of a pneumatic system includes a control valve. A pneumatic system control unit is a trigger mechanism. The control unit trigger 22 is hinged on the control valve slide component 23. The valve body houses a support 24, in relation to which the displacement of the trigger 22 and, accordingly, the slide component 23 fixed in the valve body with a limited translation possibility takes place. A spring 26 is fixed between the supporting surface of the slide component 23 and the supporting surface 25 of the body. A pneumatic system is provided with a pneumatic cylinder 38, the piston of which 27 is kinematically connected via a lever mechanism 28 with the rod 7. There is a spring 29 resting on the pneumatic cylinder body 38 in the space above the piston 27.

The valve is made with three connectors the first connection of the valve is with a gas chamber 8. The second connection is with a control chamber 31 of a pneumatic cylinder 38. The third connection communicates with draining. The slide component 23 has channels 32 linking via a corresponding connection, under the initial position of the trigger mechanism, the control chamber 31 of the pneumatic cylinder 38 with draining, and while pressing the trigger 22—a gas chamber 8 with the control chamber 31 of the pneumatic cylinder 38. All movable components of controlled and control valves and a pneumatic cylinder 38 are sealed by sealings 39 made in the form of sealing rings.

The device for generating a gas-droplet stream and a valve, as its structural part, designed for a two-phase working fluid supply function in the following way.

The device is put into the initial operating condition. The valves 19 and 20 are open on liquid supply pipes from the tank 16 and gas supply pipes from the bottle 15. The air enters the reducer 18 controlling (decreasing) the pressure level in a particular range. The gas coming from the reducer 18 outlet fills flexible hoses 10 and 11, through which it passes into the tank pressurization chamber 16 and the gas chamber 8 of the two-phase working fluid supply controlled valve. Under pressurized liquid supply from the tank 16 the water sequentially fills the flexible hose 10 and the liquid chamber 9 of the controlled valve.

Therefore, under the initial operating condition of the device the controlled valve chambers 8 and 9 are filled, accordingly, with air and water with a normally closed state of closure valve members 5 and 6.

With a control signal transmitted to the rod displacement control system illustrated in FIG. 1 the control unit 14 connects the drive 13 and an electric power source. The drive 13 switched on, the displacement of the rod 7 and the closure member 5 and the stop 13 rigidly connected with it up to a certain position determined by a displacement limiter (not shown in FIG. 1) takes place. At first there occurs the water supply valve opening with the closure member 5 separation from the seat located in the gas chamber 8.

The attribute of the device is that the air supply valve opening takes place with delay in relation to the moment of the water supply valve opening, which is determined by a gap value between the supporting surface of the stop 35 and the opposite supporting surface of a movable closure member 6. The optimum gap "a" value is 0.3 to 1 mm ( for a case considered a=0.5 mm). The water supply valve opens in such a manner after the stop 12 completing a stroke "a" and overcoming the force, with which the movable closure number 6 is pressed to the seat by a spring.

With the control valve of two-phase working fluid supply closed, the control unit 14 carries out the corresponding connection of the drive 13 and the power source, as a result of which the rod 7 displaces into its initial position. In this case with the rod 7 return stroke the liquid supply valve closes first, the closure member 6 of which is pressed by a spring to the seat of the liquid chamber 9. After that the air supply valve remains open during the time of an extra motion of the rod 7, which is determined by the gap "a " value. The present embodiment allows to carry out a possibility of a preliminary liquid cutoff supplied to the mixing chamber prior to the gas flow supply cutoff.

Carrying out a required algorithm of liquid and gas supply allows to preliminarily supply the air flow and then the water flow dispersed by means of the facility 3 made in the form of a rigid cylinder wall with injection orifices into the mixing chamber 2. Thus, the water streams entering the chamber 2 are immediately enveloped by the air flow, in which additional liquid dispersion and mixing with gas takes place. A s a result of the procedures described a two-phase flow is formed in the chamber, which then passes into the nozzle 1, in which the flow is accelerated and an accelerated gas-droplet stream is generated flowing in A direction (see FIG. 1).

With the device turned off, the water flow being a working fluid, in this case for fire extinguishing, is cut off to the mixing chamber 2, and then the gas-carrier flow cutoff comes. This procedure sequence allows to generate sufficiently fast an accelerated gas-droplet stream and shut off the working fluid flow with minimum losses of a limited liquid supply. This procedure sequence is especially important under the device multistarts, e.g., in extinguishing local fire sites.

In another embodiment of the device illustrated in FIG. 2, which is preferable for manual control of the device, a pneumatic system with a trigger mechanism placed in the body 4 handle 21 is used as a rod displacement control system. In pressing the trigger 22 in direction F (see FIG. 2) its displacement in relation to a support 2—as well as a translational motion of a control valve slide component 23 hinged to the trigger 22 in direction C take place.

The slide component 23 motion is opposed by a spring elasticity force resting on the body 4 surface 25. With the trigger 22 fully withdrawn back in direction F the spring 26 is in its compressed state, and the slide component 23 set in a position, when the channels 32 transmit the valve connection linked with the gas chamber 8 with the valve connection linked with a control chamber 31 of the pneumatic cylinder 38. As a result a pressurized air assigned by the reducer 18 passes from chamber 8 to control chamber 31 increasing the pressure P in it. On account of the excessive pressure acting on the piston 27 it displaces upwards coming over the spring elasticity resting on the body of the pneumatic cylinder 38.

During displacement the piston 27 is effecting the rod via a lever mechanism 28, which on account of that moves in direction B (see FIG. 2).On account of the lever mechanism arm ratio choice 28 b/c=⅕ the piston 27 diameter is 20 mim, which allows to place a pneumatic cylinder 38 in the handle 21, the size of which is acceptable for a manual control convenience. The gaps between the rod 7 and the chamber walls 8 and 9 are sealed with sealing 39 both under immovable rod 7 position and its motion.

When the rod 7 displaces, first a closure member 5 fixed in the gas chamber 8 seat 33 opens, and then with a delay determined by a gap "a" size, the stop 35 comes in contact with a supporting surface of the displaced closure member 6 and removes it from the seat 34 in the liquid chamber 9 coming over the spring 37 elasticity force pressing in its initial state the closure member 6 to the seat 34. As a result of ensuring this procedure sequence of closure member 5 and 6 motion the air flow valve opening occurs with a delay in respect to the moment of water flow valve opening. The delay duration is determined by a gap size between the supporting surface of the stop 35 and the opposite supporting surface of a movable closure member 6.

Therefore, when the device is turned on there takes place a preliminary supply of the air flow and then a water flow in the form of thin streams due to its flowing through injection orifices made in the cylindrical wall 3 serving as a means of liquid dispersion.

After the water flow supplied to the mixing chamber, the device immediately achieves an assigned operating mode on account of the fact that the water streams entering the mixing chamber 2 are caught up by the air flow, in which an additional liquid dispersion and its mixing with gas take place. As a result of the procedures in the chamber 2 described a two-phase flow is generated, which then passes into the nozzle 1, where a flow acceleration and an accelerated gas-droplet stream flowing in direction A (see FIG. 2) occur.

To close a control valve of two-phase working fluid supply described in FIG. 2 the trigger 22 is relieved of the force, after which the slide component under the force of a preliminarily compressed spring 26 displaces into its initial state. The controlled valve connection linked with the gas chamber 8 is cut off. The channels 32 in the slide component 23 link the valve connection in its initial state, connected with a control chamber 31 of the pneumatic cylinder 38 with the connection linked with draining. As a result the pressure Pc reduces up to the atmospheric one. After that the piston 27 under the effect of a compressed spring 29 force displaces into its initial position interacting with a lever mechanism 28, which is in its turn connected with the rod 7.

Under the effect of the applied force the rod 7 displaces into its initial position. In the process of the rod 7 motion against direction B there occurs a sequential closure, first, of the liquid flow supply valve at the contact of a closure member 5 with the seat 3 and, then, the gas flow supply valve at the contact of a closure member 6 with the seat 34.

A delay of gas flow supply valve closure with respect to liquid flow supply valve closure is also determined by a gap "a" value between the supporting surface of the stop 35 and the opposite supporting surface of the movable closure member 6. Thus, a possibility is effected of preliminary liquid flow supply cutoff to the mixing chamber prior to gas flow supply cutoff. This possibility carried out under manual valve control of two0phase working fluid flow supply allows to exclude non-productive working fluid losses, the supply of which is limited by a 16 l tank capacity, in the process of two-phase low supply cutoff and ensure the readiness for a device restart.

During the device operation the gas pressure at the nozzle inlet P and relative liquid g concentration in a two-phase flow are selected from a certain condition:

$$P \cdot g \leqq 5{,}7 \cdot 10^8 Pa,$$

where $g = G_l / G_g$ $G_l$—mass liquid flow;

$G_g$—mass gas flow.

This condition characterizes an ultimate liquid particle density in the gas flow, when it is possible to generate a gas-droplet liquid phase in gas (see Application WO 98/012331 A1). While carrying out this condition there appears a possibility to accelerate a two-phase flow up to a desired speed in the nozzle, the flow consisting of a droplet liquid phase and gas-carrier.

A desired speed of a gas-droplet stream, at which a required stream flight range is achieved, is determined by a gas pressure value at the nozzle 1 inlet. The assigned gasdroplet stream range depending on the fire extinguishing conditions is also achieved at a certain gas pressure value level by selecting a profiled nozzle 1 channel length, which is made changeable for this purpose. A required uniformity of extinguishing substance dispersion and finely dispersed drop homogeneity in the air flow, the average diameter of which is 50 mm, is ensured also by selecting a changeable nozzle 1 length, size, quantity and injection orifice arrangement of a liquid flow dispersion means.

The knowledge given above is the evidence of a possibility to carry out a group of inventions patented and achieve the said technical result.

INDUSTRIAL APPLICATION

A device for generating a gas-droplet stream including, as its structural member, a valve for two-phase fluid flow supply according to the invention patented can be used in different fields of activity, where a controlled supply of gas-droplet streams is required to solve different problems. First of all, the inventions can be effectively used for fire extinguishing, particularly, in enclosed premises and hardly accessible fire sites.

In fire fighting technology the inventions can be applied as a means of developing a fog-like screen and directed fire extinguishing two-phase flows. The inventions can In fire fighting technology the inventions can be applied as a means of developing a fog-like screen and directed fire extinguishing two-phase flows. The inventions can also be used in farming for field sprinkling and different—type substance dispersion (these prior art devices are known from, e.g., the Author's Certificate SU 380279).

Besides, the devices embodied in accordance with the inventions patented can be used as a home appliance means for different substance dispersion in the rooms with a purpose of disinfecting, deodorization and anticepting.

Though an invention patented is described on the basis of a preferable embodiment designed for fire extinguishing, the specialists in this field of art understand that alterations, e.g., while using other working fluids, and other structural embodiments of the device and the valve without deviation from a common idea and the subject matter of the inventions can take place according to the claims presented.

The claims defining the invention are as follows:

1. A device for generating a gas-droplet stream comprising a gas-dynamic nozzle (1) connected with a gas and liquid mixing chamber (2), a means (3) of liquid flow dispersion supplied to the mixing chamber (2), with injection orifices and a liquid and gas supply system, characterized by the fact that the liquid and gas supply system comprises at least one pressurized gas bottle (15) and one water tank (16), a gas pressure regulator (18) and connecting hoses (10, 11 and 17) thereby the mixing chamber (2) is connected with the liquid and gas supply system via a controlled valve of two-phase working fluid supply made with a possibility of a preliminary gas flow supply to the mixing chamber (2) prior to a liquid flow supply into it at the start of the device and with a possibility of a preliminary liquid flow cutoff to the mixing chamber (2) prior to a gas flow cutoff, when the device is turned off, hereby hoses (10, 11 and 17) connect the water tank (16) with a controlled valve liquid chamber (9) and the bottle (15) with a controlled valve gas chamber (8) and with a tank (16) pressurization gas chamber.

2. The device of claim 1, characterized by the fact that the nozzle (1) is mounted on the mixing chamber (2) body by means of a detachable coupling.

3. The device of claim 1, characterized by the fact that the controlled valve is fixed in a common body (4) together with the mixing chamber (2).

4. The device of claim 3, characterized by the fact that the body (4) is provided with at least one handle (21).

5. The device of claim 4, characterized by the fact that a valve control trigger mechanism is placed in the handle (21).

6. The device of claim 1, characterized by the fact that the controlled valve is made in the form of two closure members (6 and 7) fixed on a rod (7) and interacting with seats located on a sealed chamber (8 and 9) walls connected accordingly with gas and liquid supply pipes (10 and 11), and comprises a rod displacement limiter (36), a stop (35) rigidly fixed on the rod, as well as a rod displacement control system, one closure member (5) rigidly fixed on the rod (7) with a possibility of a seat (33) contact in the gas chamber (8), the second closure member (6) fixed coaxially on the rod (7) with a possibility of displacement along it, while interacting with the stop (35), and with a possibility of a seat contact in a liquid supply chamber (9), an elastic component (37) pressing a movable closure member (6) against a respective seat (34) mounted between the liquid supply chamber (9) wall and a movable closure member (6), the supporting surface of the stop (35) in a normally closed position of the valve is placed with a gap in relation to the opposite supporting surface of the movable closure member (6).

7. The device of claim 6, characterized by the fact that the gap value is 0,3 to 1 mm.

8. The device of claim 6, characterized by the fact that the rod displacement control system includes at least one control valve.

9. The device of claim 6, characterized by the fact that the rod displacement control system is made in the form of a pneumatic system.

10. The device of claim 9, characterized by the fact that a trigger mechanism placed in the handle (21) of the body (4) is used as a pneumatic system control unit.

11. The device of claim 10, characterized by the fact that a mechanism trigger (22) is hinged to a control valve slide component (23), the slide component fixed in the valve body with a possibility of a limited translational displacement, an elastic component (26) mounted between the supporting surface of the slide component (23) and the supporting surface (25) of a device body.

12. The device of claim 9, characterized by the fact that a pneumatic system is provided with a pneumatic cylinder (38), a piston (27) of which is kinematically connected via a lever mechanism (28) with the controlled valve rod (7), an elastic component resting on the pneumatic cylinder body mounted in the above-piston (27) space.

13. The device of claim 6, characterized by the fact that at least one spring is used as an elastic component.

14. The device of claim 12, characterized by the fact that a controlled valve is made with three connections, the first valve connection linked with a controlled valve gas chamber (8), the second connection is linked with the pneumatic cylinder control chamber (31), the third connection is linked with drain, the slide component (23) having channels (32) linking via a respective connection a pneumatic cylinder control chamber (31) with the initial position of a trigger mechanism, and while pressing the trigger (22) a gas chamber (8) of the controlled valve with a pneumatic cylinder control chamber (31).

15. The device of claim 1, characterized by the fact that the liquid is selected from the group consisting of the liquid used for fire extinguishing, water, the liquid used for disinfecting, the liquid used for deodorization, and the liquid used for anticepting.

16. The device of claim 1, characterized by the fact that the tank and the bottle of the liquid and gas supply system are arranged in a back-pack placed with a gap in relation to the opposite supporting surface of the movable closure member (6).

17. The device of claim 1, characterized by the fact that the liquid and gas supply system is placed on a transport means.

18. A two-phase working fluid supply valve comprising two closure members (5 and 6) placed on a rod (7) and interacting with seats (33 and 34) located on a sealed chamber (8 and 9) walls connected respectively with liquid and gas supply pipes, a rod (7) displacement limiter (36) and a rod displacement control system, characterized by the fact that in addition it includes a stop (35) rigidly fixed on the rod, one closure member (5) rigidly fixed on the rod (7) with a possibility of a seat (33) contact in the gas supply chamber (8), a second closure member (6) coaxially fixed on the rod (7) with a possibility of displacing along it, while interacting with the stop (35), and a possibility of a seat (34) contact in the liquid supply chamber (9), an elastic component (37) pressing a movable closure member (16) against a respective seat (34) is mounted between the liquid supply chamber (9) wall and a movable closure member (6), and in a normally closed position of the valve the supporting surface of the stop is located with a gap in respect to the opposite supporting surface of a movable closure member(6).

19. A valve of claim 18, characterized by the fact that the gap value is 0,3 to 1 mm.

20. A valve of claim 18, characterized by the fact that the rod displacement control system comprises at least one controlled valve.

21. A valve of claim 18, characterized by the fact that the rod (7) displacement control system is made in the form of a pneumatic system.

22. A valve by claim 21, characterized by the fact that a pneumatic system is provided with a pneumatic cylinder (38), the piston (27) of which is cinematically connected via a lever mechanism (28) with the rod (7), an elastic component (29) resting on the pneumatic cylinder body fixed in the above-piston (27) space.

23. A valve of claim 19, characterized by the fact that at least one spring is used as an elastic component.

24. A valve of claim 22, characterized by the fact that a control valve is made with three connections, the first valve connection linked with a gas chamber (8), the second connection linked with a pneumatic cylinder chamber (31), the third connection linked with drain, a slide component (23) having the channels (32), which link, via a respective connection and under the initial position of the trigger mechanism, a control chamber (31) of the pneumatic cylinder with drain, and while pressing the trigger (22) a gas chamber (8) with a control chamber (31) of the pneumatic cylinder.

25. The device of claim 17, characterized by the fact that the transport means is selected from the group consisting of a trolley, an automobile and an electromobile.

* * * * *